US009650793B2

(12) United States Patent
Otto et al.

(10) Patent No.: US 9,650,793 B2
(45) Date of Patent: May 16, 2017

(54) ADJUSTABLE GUIDE LINE HOLDER

(71) Applicants: Daniel Ray Otto, Cannelburg, IN (US); Beth Ballenger Otto, Cannelburg, IN (US)

(72) Inventors: Daniel Ray Otto, Cannelburg, IN (US); Beth Ballenger Otto, Cannelburg, IN (US)

( * ) Notice: Subject to any disclaimer, the term of this patent is extended or adjusted under 35 U.S.C. 154(b) by 101 days.

(21) Appl. No.: 14/741,433

(22) Filed: Jun. 16, 2015

(65) Prior Publication Data

US 2015/0368918 A1 Dec. 24, 2015

Related U.S. Application Data

(60) Provisional application No. 62/014,635, filed on Jun. 19, 2014.

(51) Int. Cl.
*E04G 21/18* (2006.01)

(52) U.S. Cl.
CPC ..... *E04G 21/1825* (2013.01)

(58) Field of Classification Search
CPC ..... E04G 21/1808; E04G 21/1825; E04G 21/1841; G01C 15/00; A01D 34/416; A01D 34/73
USPC ..... 33/409, 404, 405, 406, 407, 413
See application file for complete search history.

(56) References Cited

U.S. PATENT DOCUMENTS

| | | | | | |
|---|---|---|---|---|---|
| 182,076 | A * | 9/1876 | Jones | B44D 3/38 | 33/413 |
| 552,184 | A * | 12/1895 | Kaufmann | B44D 3/38 | 33/413 |
| 577,708 | A * | 2/1897 | Barrie | B44D 3/38 | 33/340 |
| 2,809,434 | A | 10/1957 | Cordier | | |
| 2,811,778 | A | 11/1957 | Snyder | | |
| 2,991,557 | A | 7/1961 | Bongiovanni | | |
| 3,104,468 | A * | 9/1963 | Sarles | E04G 21/1808 | 33/406 |
| 3,571,931 | A | 3/1971 | Williams | | |
| 4,057,903 | A * | 11/1977 | Cantera | E04G 21/1816 | 33/339 |
| 4,077,127 | A * | 3/1978 | Herrington | G01C 15/12 | 33/406 |

(Continued)

FOREIGN PATENT DOCUMENTS

| | | |
|---|---|---|
| DE | 1 940 755 | 2/1971 |
| FR | 997633 | 1/1951 |

*Primary Examiner* — Yaritza Guadalupe-McCall

(57) ABSTRACT

The adjustable guide line holder is a mason's guide line holder, including a housing having an adjustable longitudinal width for secure reception within a brick pocket of a gable. The housing includes outer and inner portions respectively having first and second sets of top, bottom and side walls. The inner portion is received within the outer portion such that the first and second side walls are longitudinally opposed with respect to one another, with the inner and outer portions being adjustably slidable with respect to one another such that the housing has an adjustable longitudinal width. A vertical support is received within the inner portion and extends between the top and bottom walls thereof. A cross member is mounted to the vertical support, such that one end of a masonry guide line may be secured to the cross member.

19 Claims, 4 Drawing Sheets

(56) References Cited

U.S. PATENT DOCUMENTS 4,189,844 A * 2/1980 Riggins, Sr. ..... G01C 9/28 33/332
5,022,158 A * 6/1991 Beyer ..... B44D 3/38 33/1 LE
5,392,523 A 2/1995 Hurt
5,964,042 A 10/1999 Carper
6,098,299 A * 8/2000 Collins ..... B44D 3/38 24/122.3
6,148,529 A * 11/2000 Kennedy ..... G01C 9/26 33/369
6,412,184 B1 * 7/2002 Heavner ..... E04G 21/1808 33/1 LE
6,615,502 B2 9/2003 Newman
6,842,992 B1 * 1/2005 Gitt ..... E04G 21/1833 33/1 LE
7,028,411 B1 * 4/2006 Kasche ..... G01C 9/26 33/414
7,497,023 B1 * 3/2009 Simmons ..... E04G 21/1825 33/1 LE
7,669,343 B2 * 3/2010 Reynolds ..... E04G 21/1816 33/1 LE
7,673,393 B1 * 3/2010 Hudson ..... E04G 21/1825 33/407
7,779,546 B2 * 8/2010 Bond ..... G01C 15/02 33/1 LE
8,819,949 B2 * 9/2014 Fritsch ..... B44D 3/38 33/354
2007/0029433 A1 * 2/2007 Bond ..... B65H 75/04 242/400.1
2008/0006005 A1 * 1/2008 Bashour ..... E04G 21/1808 52/749.14
2009/0158561 A1 * 6/2009 Reynolds ..... E04G 21/1816 24/457
2009/0255138 A1 * 10/2009 Stoklosa ..... B25H 7/04 33/32.2
2015/0368918 A1 * 12/2015 Otto ..... E04G 21/1825 33/518

* cited by examiner

ADJUSTABLE GUIDE LINE HOLDER

CROSS-REFERENCE TO RELATED APPLICATION

This application claims the benefit of U.S. Provisional Patent Application Ser. No. 62/014,635, filed Jun. 19, 2014.

BACKGROUND OF THE INVENTION

1. Field of the Invention

The present invention relates to brick masonry, and particularly to an adjustable mason's guide line holder for adjustably securing and suspending a mason's guide line in the construction of a bricked-in gable under a roof.

2. Description of the Related Art

Many houses require the construction of a bricked-in gable under the roof. In constructing such gables, it is common practice to use a guide line suspended above the bricks that are being mortared into place under the gable. By following the guide line, the brick mason is assured that the stacked bricks and mortar remain even and level as the stack is built up even with the guide line suspended under the gable. Clamping devices for holding and suspension of the guide line are known, with such devices typically being referred to as mason's guide line holders. In a typical mason's guide line holder, a pair of clamps suitable for holding a suspended line are attached to opposite ends of the gable face boards under the roof. Such devices, though, require the mason to constantly un-fasten and move the clamps, and then re-set and re-fasten the pair of clamps as the stack of bricks becomes taller.

Thus, an adjustable guide line holder addressing the aforementioned problems is desired.

SUMMARY OF THE INVENTION

The adjustable guide line holder is a mason's guide line holder, including a housing having an adjustable longitudinal width for secure reception within a brick pocket of a gable. The housing includes an inner portion and an outer portion, with the outer portion having a first set of top and bottom walls and a first sidewall, and with the inner portion having a second set of top and bottom walls and a second sidewall. The inner portion is at least partially received within the outer portion such that the first and second sidewalls are longitudinally opposed with respect to one another. The inner and outer portions are adjustably slidable with respect to one another such that the housing has an adjustable longitudinal width. A vertical support is received within the inner portion of the housing and extends between the top and bottom walls thereof. A cross member is mounted to the vertical support, such that one end of a masonry guide line may be secured to the cross member.

In use, a pair of the adjustable guide line holders are secured within the brick pockets of opposed sides of the gable. Each end of the masonry guide line is secured about a respective cross member to extend across the open gable, serving as a masonry guide for brick laying therein. Each of the adjustable guide line holders is adjusted to have a longitudinal width matching, or slightly greater than, the width of the brick pocket to ensure secure frictional engagement with the walls of the gable which define the brick pocket.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
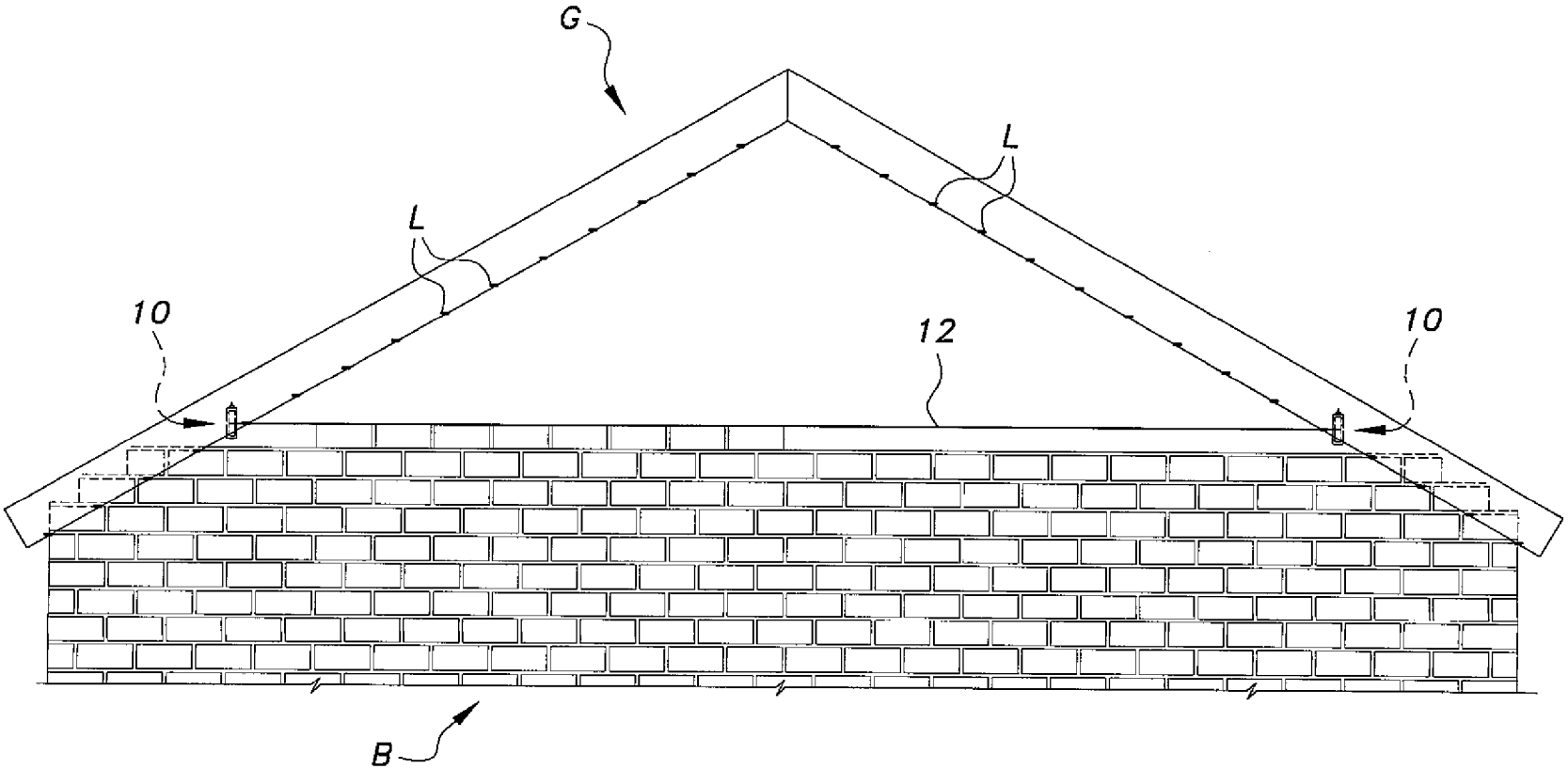
FIG. 1 is an environmental side view of a pair of adjustable guide line holders according to the present invention.
Figure 2:
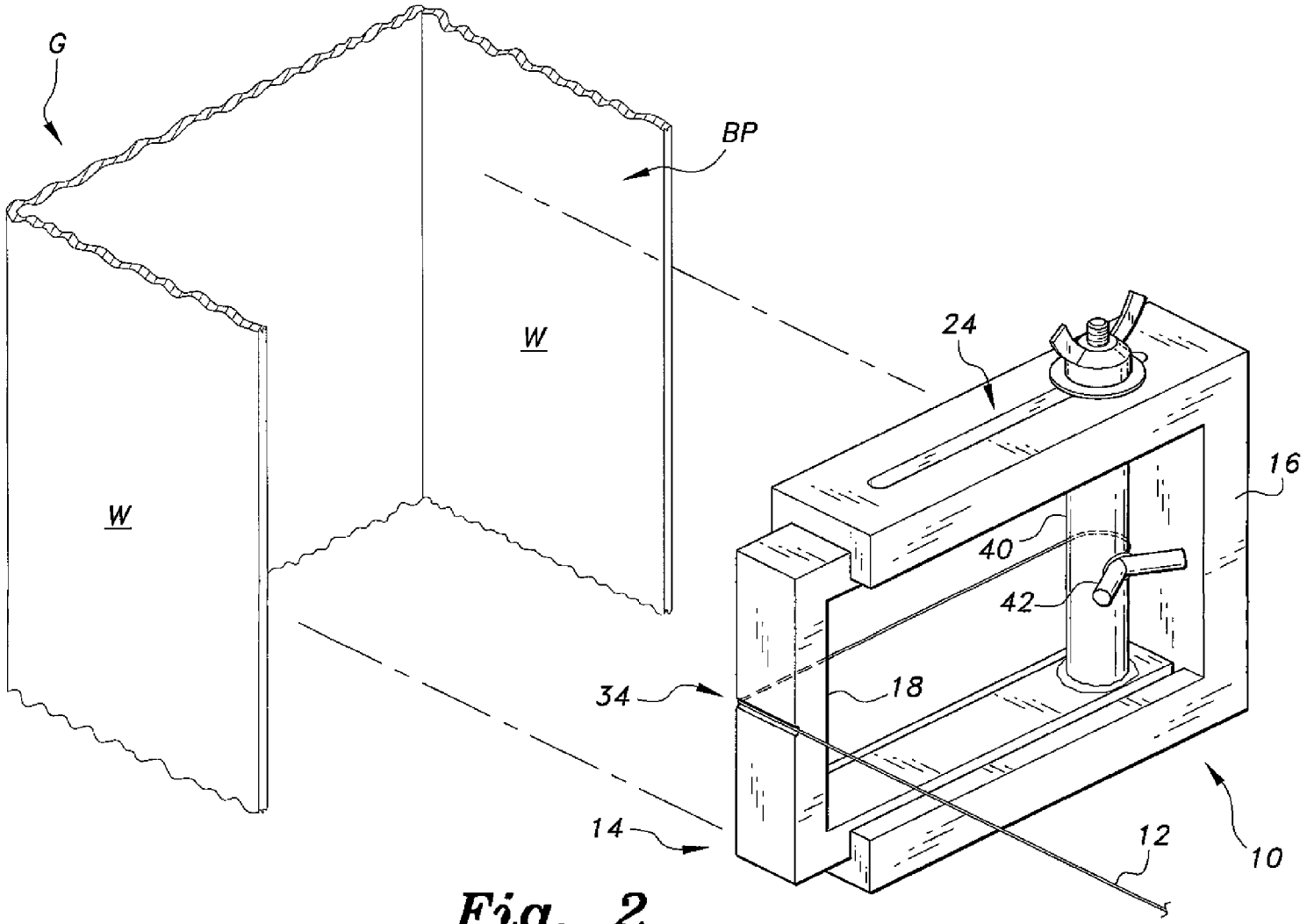
FIG. 2 is a perspective view of the adjustable guide line holder according to the present invention.

As best shown in FIGS. 1 and 2, a pair of the adjustable guide line holders 10 are secured within the brick pockets BP of opposed sides of a gable G. Each end of a masonry guide line 12 is secured to a respective one of the adjustable guide line holders to serve as a masonry guide for brick laying therein. As will be described in greater detail below, each of the adjustable guide line holders 10 is adjustable along its longitudinal width such that the longitudinal width thereof matches, or is slightly greater than by approximately ⅛ of an inch, for example, the width of the brick pocket BP to ensure secure frictional engagement with the walls W of the gable G which define the brick pocket BP.

In constructing a bricked gable, as shown in FIG. 1, the pair of the adjustable guide line holders 10 are used to suspend the masonry guide line 12 above the bricks B that are being mortared into place under the gable G. By following the masonry guide line 12, the brick mason is assured that the stacked bricks and mortar remain even and level as the stack is built up even with the guide line 12 suspended under the gable G. As shown, the mason may make temporary marking lines L along the front side of the gable G to show the desired level for guide line positioning as the wall of bricks B is built. In the example of FIG. 1, the top layer of bricks is only partially complete, for illustrative purposes. Once this row of bricks B has been completed, the mason may remove the adjustable guide line holders 10 from their present positions and finish laying bricks in this row within the brick pockets in the spaces formerly occupied by the adjustable guide line holders. The adjustable guide line holders may then be re-positioned on the new top row of bricks B, within the brick pockets BP, for laying of the next row of bricks B.

Figure 3:
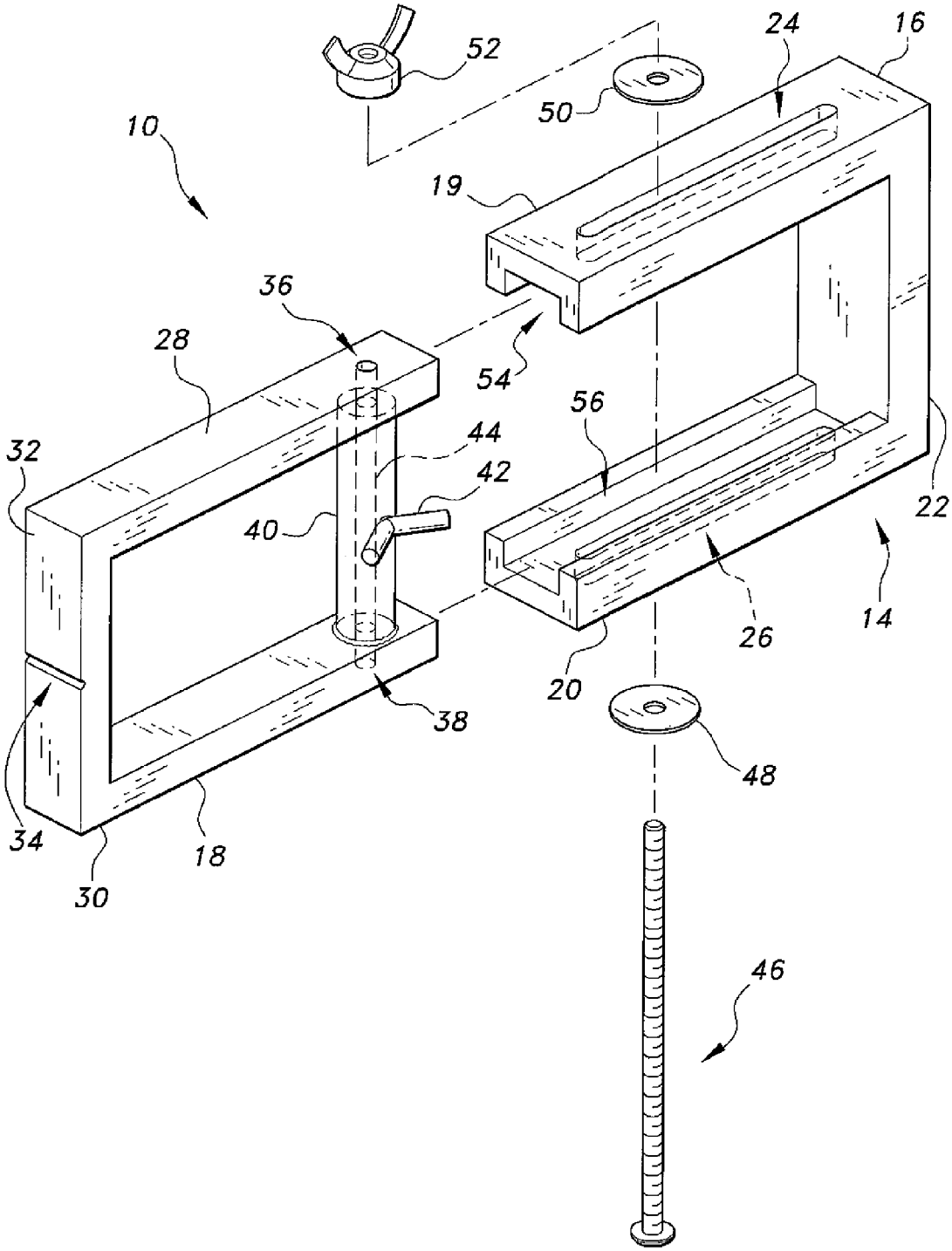
FIG. 3 is an exploded view of the adjustable guide line holder according to the present invention.

As shown in FIGS. 2 and 3, each adjustable guide line holder 10 includes a housing 14, forming a substantially rectangular frame having an adjustable longitudinal width. The housing 14 includes an outer portion 16 and an inner portion 18. Outer portion 16 has a first set of top and bottom walls 19, 20, respectively, and a first sidewall 22, forming a substantially U-shaped frame. Similarly, inner portion 18 has a second set of top and bottom walls 28, 30, respectively, and a second sidewall 32, also forming a substantially U-shaped frame. As shown in FIG. 2, the inner portion 18 is at least partially received within the outer portion 16 such that the first and second sidewalls 22, 32, respectively, are longitudinally opposed with respect to one another. The outer and inner portions 16, 18 are adjustably slidable with respect to one another such that the housing 14 has an adjustable longitudinal width. As shown in FIG. 3, upper and lower recesses or grooves 54, 56 may be formed in the inner faces of the upper, or top, and lower, or bottom, walls 19, 20 of outer portion 16, allowing the upper, or top, and lower, or bottom, walls 28, 30 of inner portion 18 to be slidably received therein.

As shown in FIG. 2, the longitudinal width of the housing 14 is adjusted such that it matches, or is slightly greater than by approximately ⅛ of an inch, for example, the width of the brick pocket BP to ensure secure frictional engagement of sidewalls 22, 32 with the walls W of the gable G which define the brick pocket BP. The outer and inner portions 16, 18 of housing 14 may be constructed of any suitable material, such as wood, a metal material or the like, providing secure frictional engagement with the walls W defining brick pocket BP.

As best shown in FIG. 3, a vertical support 40 is received within the inner portion 18 of the housing 14 and extends between the top and bottom walls 28, 30. The vertical support 40 has a channel 44 defined therethrough, with apertures 36, 38 being respectively formed through top and bottom walls 28, 30 so as to communicate with channel 44. As shown, slots 24, 26 are respectively formed through top and bottom walls 19, 20 of the outer portion 16, each extending longitudinally, such that when inner portion 18 is received within outer portion 16, the apertures 36, 38 are aligned within the respective slots 24, 26. Once the apertures 36, 38 are aligned with slots 24, 26, a threaded bolt 46 or the like may be inserted through passage 44 and secured with a wing nut 52 or the like to secure the outer portion 16 to the inner portion 18. Washers 48, 50 may be provided to ensure firm securement about slots 26, 24. When wing nut 52 is loosened, the opposed ends of threaded bolt 46 may slide within longitudinally-extending slots 24, 26 to adjust the longitudinal width of housing 14. Once a desired width is achieved, the wing nut 52 may be tightened to fix the housing 14 at the desired width.

A cross member 42 is mounted to the vertical support 40, as shown, such that one end of masonry guide line 12 may be secured to the cross member 42, by tying the line thereabout or the like. As shown in FIGS. 2 and 3, a groove 34 is formed in the external face of sidewall 32 for receiving the guide line 12 and securing the guide line 12 at the desired height. Once a layer of bricks B is completed, the adjustable guide line holders 10 are removed, and the ends of the guide line 12 may be looped again about the respective cross members 42 to shorten the overall length of the line 12. It should be understood that the ends of the guide line 12 may be secured about the vertical support 40 and/or to the cross member 42 by any suitable method, and the overall length of guide line 12 may also be adjusted by any suitable method such that the guide line 12 is held taut between the pair of adjustable guide line holders 10. Additionally, although cross member 42 is shown as having a substantially V-shaped contour, it should be understood that cross member 42 may have any desired contouring or relative dimensions.

It should be understood that housing 14 may be manufactured in any desired size or with any desired overall contouring, and that which is shown in the FIGS. 1-3 is shown for exemplary purposes only. For use with gables having conventional measurements, the outer portion 16 of housing 14 may, for example, have a height of approximately 2¼ inches, with the top and bottom walls each having a longitudinal width of approximately 5¾ inches and a lateral width of approximately 3¾ inches. It should be understood that these dimensions are provided only as an example, and that the adjustable guide line holder 10 may have any suitable relative dimensions, as can depend on the particular use or application, and should not be construed in a limiting sense.

Figure 4:
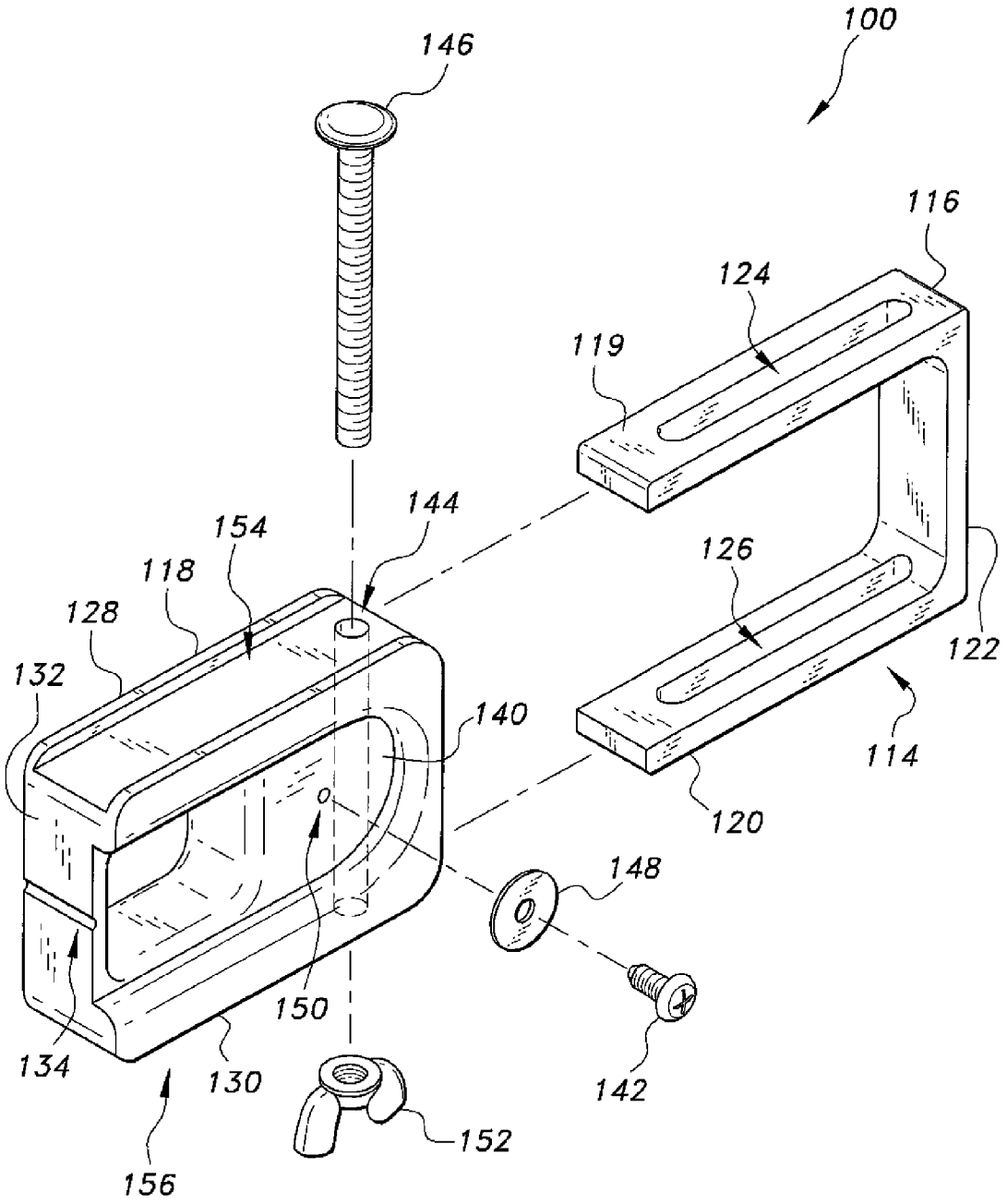
FIG. 4 is an exploded view of an alternative embodiment of the adjustable guide line holder.

In the alternative embodiment of FIG. 4, the adjustable guide line holder 100 is similar to adjustable guide line holder 10, including a housing 114 which forms a substantially rectangular frame having an adjustable longitudinal width. Similar to the previous embodiment, the housing 114 includes an outer portion 116 and an inner portion 118. Outer portion 116 has a first set of top and bottom walls 119, 120, respectively, and a first sidewall 122, forming a substantially U-shaped frame. Similarly, inner portion 118 has a second set of top and bottom walls 128, 130, respectively, and a second sidewall 132, also forming a substantially U-shaped frame.

Similar to the previous embodiment, the inner portion 118 is at least partially received within the outer portion 116 such that the first and second sidewalls 122, 132, respectively, are longitudinally opposed with respect to one another. The outer and inner portions 116, 118 are adjustably slidable with respect to one another such that the housing 114 has an adjustable longitudinal width. However, in the alternative embodiment of FIG. 4, upper and lower recesses or grooves 154, 156 are preferably formed in the outer faces of the upper, or top, and lower, or bottom, walls 128, 130 of inner portion 118, allowing the upper, or top, and lower, or bottom, walls 119, 120 of outer portion 116 to be slidably received therein.

In use, similar to that of the previous embodiment, the longitudinal width of the housing 114 is adjusted such that it matches, or is slightly greater than by approximately ⅛ of an inch, for example, the width of the brick pocket BP to ensure secure frictional engagement of sidewalls 122, 132 with the walls W of the gable G which define the brick pocket BP. The outer and inner portions 116, 118 of housing 114 may be constructed of any suitable material, such as wood, a metal material or the like, providing secure frictional engagement with the walls W defining brick pocket BP.

In the embodiment of FIG. 4, the vertical support 40 is replaced by an interior supporting member 140, received within the inner portion 118 of the housing 114 and extending between the top and bottom walls 128, 130. The interior supporting member 140 has a channel 144 defined therethrough, similar to channel 44 of the previous embodiment. As shown in FIG. 4, slots 124, 126 are respectively formed through top and bottom walls 119, 120 of the outer portion 116, each extending longitudinally, such that when inner portion 118 is received within outer portion 116, the channel 144 is aligned within the respective slots 124, 126. Once the channel 144 is aligned with slots 124, 126, a threaded bolt 146 or the like may be inserted through passage or channel 144 and secured with a wing nut 152 or the like to secure the outer portion 116 to the inner portion 118. When wing nut 152 is loosened, the opposed ends of threaded bolt 146 may slide within longitudinally-extending slots 124, 126 to adjust the longitudinal width of housing 114. Once a desired width is achieved, the wing nut 152 may be tightened to fix the housing 114 at the desired width.

As shown in FIG. 4, the cross member 42 of the previous embodiment is replaced by a threaded screw 142 or the like, received within a threaded recess 150, formed through the side of interior supporting member 140. Washer 148 may be provided to ensure firm and even releasable securement thereof. In use, one end of masonry guide line 12 may be secured by pinching or trapping the end of line 12 between the screw 142 and washer 148 or the wall of interior supporting member 140. To release or adjust the end of guide line 12, the user simply loosens screw 142. Similar to the previous embodiment, a groove 134 is formed in the external face of sidewall 132 for receiving the guide line 12 and securing the guide line 12 at the desired height. Once a layer of bricks B is completed, the adjustable guide line holders 100 are removed, and the ends of the guide line 12 may be secured again by the respective screws 142 to shorten the overall length of the line 12. It should be understood that the ends of the guide line 12 may be secured to the interior supporting member 140 by any suitable method, and the overall length of guide line 12 may also be adjusted by any suitable method such that the guide line 12 is held taut between the pair of adjustable guide line holders 100.

It is to be understood that the present invention is not limited to the embodiments described above, but encompasses any and all embodiments within the scope of the following claims.

We claim:

1. An adjustable guide line holder, comprising:

a housing having an inner portion and an outer portion, the outer portion having a first set of top and bottom walls and a first sidewall, the inner portion having a second set of top and bottom walls and a second sidewall;

wherein the inner portion is at least partially received within the outer portion such that the first and second sidewalls are longitudinally opposed, the inner and outer portions being adjustably slidable with respect to one another;

a vertical support received within said housing and extending between the top and bottom walls thereof; and a cross member mounted to said vertical support, whereby said cross member is adapted for securing one end of a masonry guide line, wherein said housing has an adjustable longitudinal width.

2. The adjustable guide line holder as recited in claim 1, wherein each of the inner and outer portions has a substantially U-shaped contour.

3. The adjustable guide line holder as recited in claim 2, wherein said vertical support is spaced apart from the second sidewall of the inner portion.

4. The adjustable guide line holder as recited in claim 3, wherein a vertical passage is formed through said vertical support and communicates with a pair of apertures respectively formed through the second set of top and bottom walls.

5. The adjustable guide line holder as recited in claim 4, wherein longitudinally extending slots are respectively formed through the first set of top and bottom walls.

6. The adjustable guide line holder as recited in claim 5, further comprising a bolt received through the longitudinally extending slots formed through the first set of top and bottom walls and through the vertical passage formed through the vertical support for slidably securing the inner portion in the outer portion.

7. The adjustable guide line holder as recited in claim 6, wherein a pair of grooves are formed in respective inner faces of the first set of top and bottom walls for slidably receiving the second set of top and bottom walls.

8. The adjustable guide line holder as recited in claim 7, wherein a horizontally extending groove is formed through an outer face of the second sidewall of the inner portion for receiving the masonry guide line.

9. An adjustable guide line holder, comprising:

a housing having an inner portion and an outer portion, the outer portion having a first set of top and bottom walls and a first sidewall, the inner portion having a second set of top and bottom walls and a second sidewall, wherein the inner portion is at least partially received within the outer portion such that the first and second sidewalls are longitudinally opposed, the inner and outer portions being adjustably slidable with respect to one another such that said housing has an adjustable longitudinal width;

an interior supporting member positioned within the inner portion of said housing and extending between the top and bottom walls thereof; and means for securing one end of a masonry guide line to said interior supporting member.

10. The adjustable guide line holder as recited in claim 9, wherein each of the inner and outer portions has a substantially U-shaped contour.

11. The adjustable guide line holder as recited in claim 10, wherein said interior supporting member is spaced apart from the second sidewall of the inner portion.

12. The adjustable guide line holder as recited in claim 11, wherein a vertical passage is formed through said interior supporting member and openly communicates with a pair of apertures respectively formed through the second set of top and bottom walls.

13. The adjustable guide line holder as recited in claim 12, wherein longitudinally extending slots are respectively formed through the first set of top and bottom walls.

14. The adjustable guide line holder as recited in claim 13, further comprising a bolt received through the longitudinally extending slots formed through the first set of top and bottom walls and through the vertical passage formed through the interior supporting member for slidably securing the inner portion in the outer portion.

15. The adjustable guide line holder as recited in claim 14, wherein a pair of grooves are formed in respective outer faces of the second set of top and bottom walls for respectively slidably receiving the first set of top and bottom walls.

16. The adjustable guide line holder as recited in claim 15, wherein a horizontally extending groove is formed through an outer face of the second sidewall of the inner portion for receiving the masonry guide line.

17. The adjustable guide line holder as recited in claim 16, wherein said means for securing one end of the masonry guide line to said interior supporting member comprises a threaded screw adjustably and releasably received within a threaded recess formed through said interior supporting member.

18. An adjustable guide line holder, comprising:

a housing having an inner portion and an outer portion, the outer portion having a first set of top and bottom walls and a first sidewall, the inner portion having a second set of top and bottom walls and a second sidewall, wherein the inner portion is at least partially received within the outer portion such that the first and second sidewalls are longitudinally opposed, the inner and outer portions being adjustably slidable with respect to one another such that said housing has an adjustable longitudinal width, a pair of grooves being formed in respective outer faces of the second set of top and bottom walls of the inner portion for respectively slidably receiving the first set of top and bottom walls of the outer portion;

an interior supporting member positioned within the inner portion of said housing and extending between the top and bottom walls thereof; and means for securing one end of a masonry guide line to said interior supporting member.

19. The adjustable guide line holder as recited in claim 18, wherein a horizontally extending groove is formed through an outer face of the second sidewall of the inner portion for receiving the masonry guide line.

* * * * *